United States Patent [19]

Ueda

[11] Patent Number: 5,060,017

[45] Date of Patent: Oct. 22, 1991

[54] SURFACE POTENTIAL CONTROL DEVICE OF PHOTOCONDUCTIVE MEMBER

[75] Inventor: Masahide Ueda, Osaka, Japan

[73] Assignee: Minolta Camera Kabushiki Kaisha, Osaka, Japan

[21] Appl. No.: 450,054

[22] Filed: Dec. 13, 1989

[30] Foreign Application Priority Data

Dec. 16, 1988 [JP] Japan ..... 63-318994

[51] Int. Cl.[5] ..... G03G 15/02

[52] U.S. Cl. ..... 355/221; 355/219

[58] Field of Search ..... 355/210, 219, 221, 225, 355/216, 204, 208; 361/230, 235; 250/324, 325, 326

[56] References Cited

U.S. PATENT DOCUMENTS

| | | | |
|---|---|---|---|
| 4,105,324 | 8/1978 | Seil | 355/208 |
| 4,456,365 | 6/1984 | Yuasa | 355/225 |
| 4,522,904 | 6/1985 | Kina et al. | 355/219 X |
| 4,811,045 | 3/1989 | Matsushita et al. | 355/219 |
| 4,920,380 | 4/1990 | Ueda et al. | 355/219 |

FOREIGN PATENT DOCUMENTS 59-37550 9/1959 Japan .

OTHER PUBLICATIONS

U.S. patent application Ser. No. 07/226,056.

*Primary Examiner*—A. T. Grimley
*Assistant Examiner*—Sandra L. Hoffman
*Attorney, Agent, or Firm*—Willian Brinks Olds Hofer Gilson & Lione

[57] ABSTRACT

Action of a charging device in an image forming apparatus is started with an output value different from a predetermined value which is set according to a characteristic of attenuation of a photoconductor, and the value is controlled so as to coincide with the predetermined value after a predetermined period of time has elapsed. It is further controlled so as to become different output characteristics at an initial stage and the latter half stage of the predetermined period of time to charge the photoconductor corresponding to actual difference in the state of attenuation caused by the difference in a period of duration when it is used and when it is not used.

9 Claims, 5 Drawing Sheets

SURFACE POTENTIAL CONTROL DEVICE OF PHOTOCONDUCTIVE MEMBER

BACKGROUND OF THE INVENTION

1. Technical Field of the Invention

The present invention relates to an image forming apparatus for use in copying machines and various printers which are provided with electrophotographic system, and more particularly, to an improvement of the control of surface potential of a photoconductor used for image formation.

2. Description of Related Art

Heretofore, various apparatuses have been offered as a mode of charging means for a photoconductor in which high voltage is applied to a charge wire which is arranged opposite to the photoconductor to generate corona discharge in order to provide the surface of the photoconductor with uniform charge thereon.

However, in case of a photoconductor which encounters great light fatigue and possesses attenuation characteristic such as a photoconductor in which selenium is used as a photoconductive member, even if a fixed charge is applied in the process of electrification, the charge maintaining capability is lowered according to the degree of light fatigue so that the charged potential is not made uniform in the area of development.

For instance, Japanese Patent Publication TOKKO SH059-37500 discloses a control device to cope with the problem. The device is arranged to stabilize the charge maintaining capability at a low value by prolonging a period of exposure corresponding to the time an image is left unformed in which the photoconductor is uniformly charged prior to image forming process. However, since a preliminary process is conducted for correcting the sensitivity of the photoconductor after print switch is turned on at the time when image forming operation is performed, there arise problems that the time required for forming a first image can not be fixed, and moreover, it takes a very long time for the image forming process of the first image after the photoconductor is left unused for a long period of time.

When the inventor of the present invention has carefully examined light fatigue characteristic of the photoconductor, it became clear that there occurs a kind of fatigue characteristic composed of a fatigue characteristic which progresses to a stablized state in a short time and a fatigue characteristic which gradually progresses to a stabilized state in a long period of time.

The reason for producing such light fatigue characteristic can not be made clear fully, however, the following reasons may be considered.

The photoconductor is arranged to receive light through exposure, eraser, main eraser and the like, while the eraser is generally constructed by arranging a plurality of LED so as to correspond with changes in the size of transfer sheet and magnification. In the wave length of light output from the LED, a wave length which does not contain long wave length is preferable since the light fatigue and a drop of charged potential are less. In an experiment conducted, it is confirmed that in case when a long wave length of light is received, the amount of drop in charged potential is large and the charged potential is kept falling for over a long period of time thus taking extremely long time until it is stabilized as against the case when a short wave length of light is received wherein the amount of drop in charged potential is comparatively smaller and the charged potential is stabilized at a fixed value in a short time. However, in the LED which outputs only a short wave length of light (green light), sufficient luminous amount can not be obtained, and therefore, the LED which outputs a long wave of light (yellow light) is practically utilized sacrificing the light fatigue to some extent.

In the photoconductor in which selenium is used, as shown in FIG. 8, when photoconductive member S is made vacuum evaporation to a conductive base plate B, a multiplicity of traps t, free radicals among atoms, are formed, and charge carriers c generated by irradiation of light are captured by the traps t and is sprung out to reach the conductive base plate B. When there are the more traps t, the more time is required for the charge carriers c to reach the conductive base plate B, and the mobility of the charge carrier c is reduced, which means dark decay is less. However, once a copying operation is started, the number of traps t appears to have been decreased since the traps t are filled by the charge carrier c, and the mobility of the charge carrier c becomes markedly high. Consequently, dark decay becomes large and the surface potential is lowered since the charge maintained on the surface of the photoconductor is neutralized even by a small amount of light. This is considered as a cause of rapid light fatigue at an initial stage.

On the other hand, the photoconductor which uses selenium is arranged in monolayer (single layer), and attainable depth of the charge carriers differs depending on the wave length of light. A short wave length of light $L_1$ is absorbed at a shallow area and generates the charge carriers c, while a long wave length of light $L_2$ is absorbed in deep layer and generates the charge carriers c. Since the selenium system photoconductor is P-type semiconductor, positive charge carriers c are able to easily move to the conductive base plate B through the charged electric field E, however, since the range of movement of negative charge carriers c is so small that the charge carriers c generated by the long wave length of light $L_2$ in the deep layer is not able to easily reach the surface. Consequently, the charge carriers c are gradually accumulated, and electric charge on the surface of the photoconductor is neutralized since the charge carrier c act as negative charge, thereby showing a phenomenon that the surface potential appears to have been lowered. This phenomenon is considered as a cause of light fatigue which is increased in a long period of time. It is thus considered that the rapid light fatigue at an initial stage and the gradually increasing light fatigue in a long period of time compose the light fatigue characteristic as described above.

SUMMARY OF THE INVENTION

A primary object of the present invention is to provide, basing on the observations of the inventor of the present invention, an image forming apparatus which is capable of controlling the surface potential of a photoconductor for obtaining an image in the stabilized density, wherein an image forming process can be carried out quickly even after the apparatus has been kept unused for a long time.

Another object of the present invention is to provide an image forming apparatus which is capable of properly charging the photoconductor corresponding to its actual damping state which changes with the passage of time, wherein a charging means starts action with a value of output different from a predetermined value, and the output is controlled so as to coincide with the value preliminarily fixed after a predetermined period of time, and is further controlled in a manner that the change of output per hour is large in the initial stage of a predetermined period and at the latter half of the predetermined period, the change of the output per hour becomes small.

A further object of the present invention is to provide an image forming apparatus which is capable of charging the photoconductor corresponding to its actual damping state with a simple circuit construction, wherein for controlling the output of the charging means, a first and second circuits arranged for performing charge and discharge of a condenser in a short or long time are separately connected in parallel to two of a plurality of varistors provided in series in the output control member of the charging means, and the first and second circuits are properly used to make the change of output per hour of the charging means large or small.

These and other objects and features of the present invention will become more apparent from the following description taken in conjunction with the accompanying drawings which illustrate specific embodiments of the invention.

BRIEF DESCRIPTION OF THE DRAWINGS

It is to be noted that like members are designated by like reference numerals and marks through the several views of the drawings on each one of the embodiments, and repeated descriptions are omitted.

DESCRIPTION OF THE PREFERRED EMBODIMENTS

Some of the embodiments of the present invention will now be described below referring to accompanying drawings.

Figure 1:
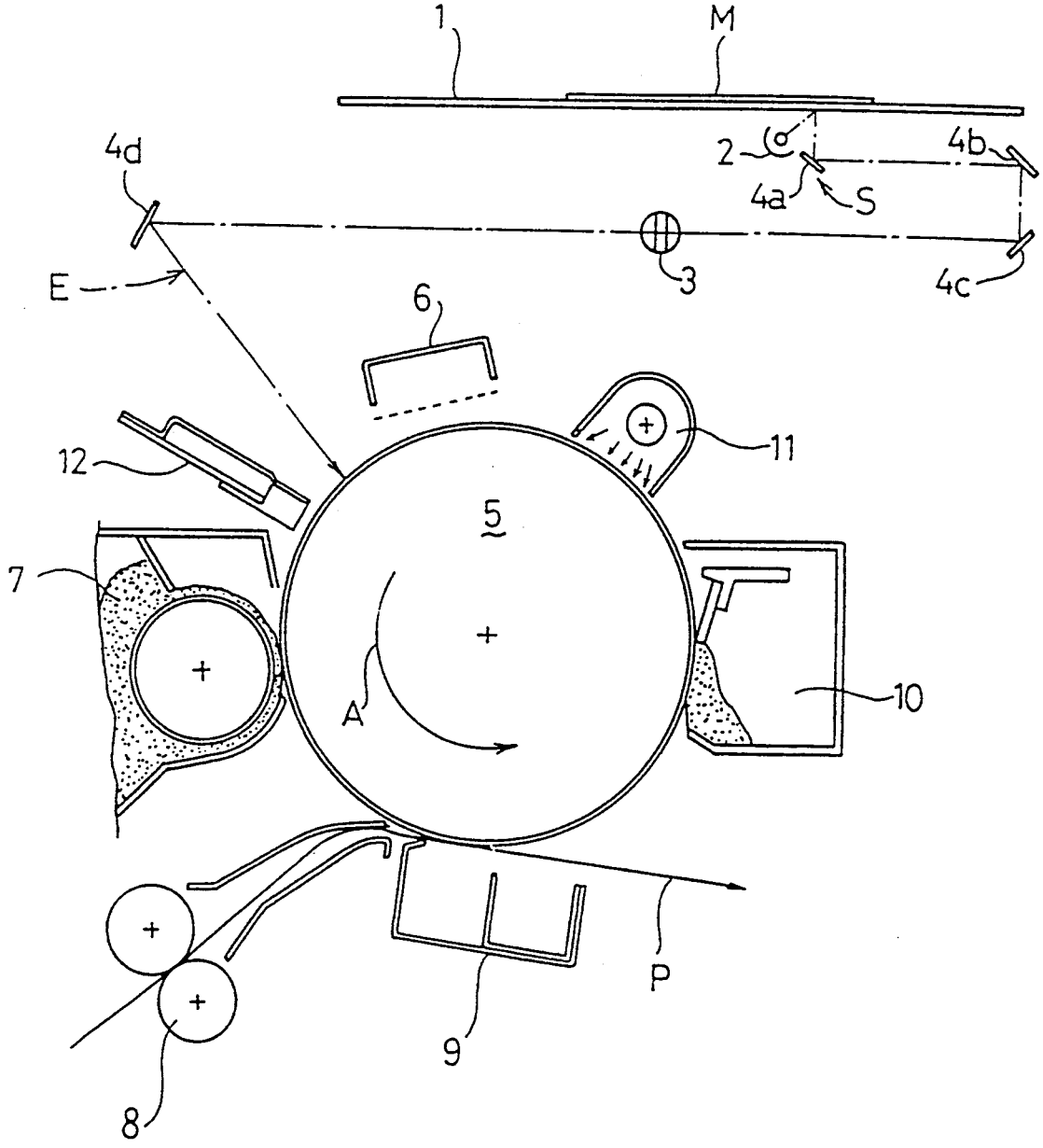
FIG. 1 is a constructional view showing the main part of a copying machine to which the present invention is applied.
Figure 2:
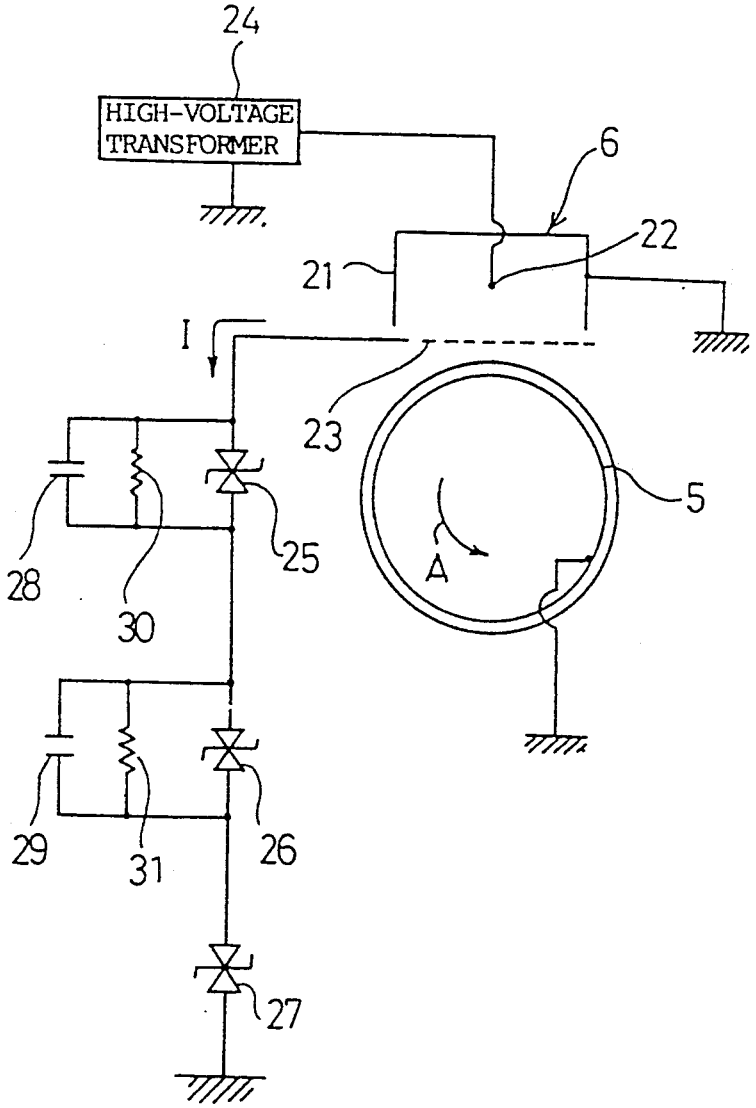
FIG. 2 is a constructional view of a charged potential control structure.

FIGS. 1 and 2 show a copying machine to which a first embodiment of the present invention is applied. Referring to FIG. 1, a general construction of the copying machine will be described.

An original M which is placed on an original table 1 consisted of glass and the like is irradiated by an exposure lamp 2 and reflected light from the original M is formed on the surface of circumference of a photoconductive drum 5 through an exposure system E comprising a lens 3 for image formation, a plurality of mirrors **4*a*–4*d*** and the like.

A scanning sytem S comprising the exposure lamp 2 and the first mirror **4*a* is constructed so as to scan the original M through its movement in the direction of right and left in the figure by an unillustrated driving mechanism. The image of the original M scanned by the scanning system S is formed on the photoconductive drum 5** being rotated in the direction of arrow A in the figure by an unillustrated driving mechanism, and an electrostatic latent image is formed.

Around the photoconductive drum 5, there are disposed a charger 6 for uniformly charging the surface of the photoconductor, a developing unit 7 for visualizing the electrostatic latent image by toner, a transfer/separation unit 9 for transferring the visualized image onto a transfer sheet P transported thereto by a register roller 8 and separating the transfer sheet P from the photoconductive drum 5, a cleaner 10 for removing excessive toner stuck to the surface of the photoconductive drum 5, a maineraser lamp 11 for dissipating charge on the photoconductive drum 5 after the visualized image is transferred onto the transfer sheet P, and the like.

The developing unit 7 is constructed so as to stick toner to the portion where charge exist on the photocondutive drum 5, that is, a development of electrostatic latent image is conducted by a regular developing method. In front of the developing unit 7, there is disposed an eraser 12 comprising a light eraser for dissipating charge on the portion other than the electrostatic latent image of the original, and by activating the charger 6, the photoconductive drum 5 is uniformly charged while removing the charge present at unnecessary area before it passes through the developing unit so that toner is not wasted.

A detailed construction of the charger 6 in the copying machine will then be described referring to FIG. 2. The charger 6 is provided with a stabilizing plate 21, a charge wire 22 and a grid 23. The stabilizing plate 21 is grounded and the charge wire 22 is connected to a high-voltage transformer 24 which is controlled by an unillustrated microcomputer. The grid 23 is disposed between the charge wire 22 and the photoconductive drum 5, and is grounded through a first varistor 25, a second varistor 26 and a third varistor 27 connected in series. A first condenser 28 and a first resistor 30 are connected with the first varistor 25 in parallel, and a second condenser 29 and a second resistor 31 are connected to the second varistor 26 in parallel. The grid 23 is so arranged as to restrict the amount of electric charge flowing into the photoconductive drum 5 from the charge wire 22 by its voltage to control a charged potential of the photocnductive drum 5.

When the copying machine is started for copying action with the mechanism described above, the photoconductive drum 5 is rotatively driven in the direction of the arrow A, and after it has reached a predetermined number of revolutions, the high-voltage transformer 24 is turned on by instruction of the microcomputer to start corona discharge from the charge wire 22. The discharged current flow into the stabilizing plate 21, the grid 23 and the surface of the photoconductive drum 5 passing through the opening of the grid 23. The grid current I flowing to the grid 23 further flows to the ground through the first varistor 25 and the first resistor 30, the second varistor 26 and the second resistor 31 and the third varistor 27, however, the grid 23 is controlled at a fixed voltage (hereinafter called as Grid Voltage Vg) by producing voltage difference across terminals of the first, second and third varistors 25,26,27.

On the other hand, the first condenser 28 is generally under a state of discharging electricity completely when the machine starts copying operation, and therefore, the grid current I flows to both the first varistor 25 and the first condenser 28 when the copying operation is started, and the first condenser 28 is charged. The second condenser 29 is also at a state of complete discharge when the machine starts copying operation, and therefore, the grid current I flows to both the second varistor 26 and the second condenser 29, and the second condenser is charged. Accordingly, the grid voltage Vg at the time of starting operation is determined by the charged voltage of the first condenser 28 and the second condenser 29, and rated voltage of the third varistor 27.

Thereafter, as the first condenser 28 and second condenser 29 are charged, the voltage generated by charging the condensers is risen and the current flows therein is decreased. Conversely, the potential differences between both terminals of the first varistor 25 and second varistor 26 are risen and the currents flowing in the first varistor 25 and second varistor 26 are increased. Finally, when the charging to the first and second condensers 28,29 is finished, the grid current I flows to the ground passing through the first, second and third varistors 25,26,27, and the sum of the potential differences of the first, second and third varistors becomes a grid voltage Vg.

The resistance value of the first resistor 30 and the second resistor 31 are so large that the current flowing therein are small, and it gives almost no effect on the potential difference of the first varistor 25 and second varistor 26. As an example, a concrete set value is shown below.

Figure 3:
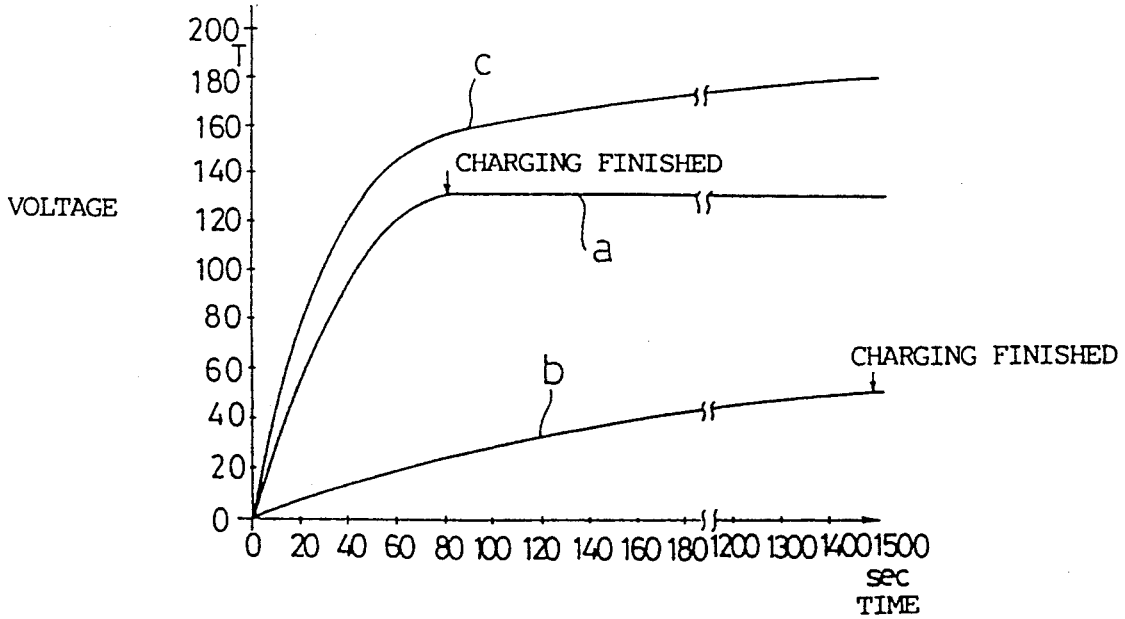
FIG. 3 is a graph showing a charging characteristic by combination of a condenser and varistor.

Rating value of First Varistor 25: 130 V
Rating value of Second Varistor 26: 50 V
Rating value of Third Varistor 27: 710 V
First Condenser 28: 24 $\mu$F
Second Condenser 29: 500 $\mu$F
First Resistor 30: 2M$\Omega$
Second Resistor 31: 20M$\Omega$
Grid Current: 100 $\mu$A
Circumferential Velocity of 350 mm/sec
Photoconductive Drum:

By using pairs of the condensers 28,29 and the varistors 25,26 in different capacities, two different charging characteristics a and b can be obtained as shown in FIG. 3. With the pairs connected in series and by composing the characteristics, a composed charging characteristic as c can also be obtained. The sum of the characteristic c and a potential difference which is produced when the grid current I flows through the third varistor 27 is given as a grid voltage Vg.

Figure 4:
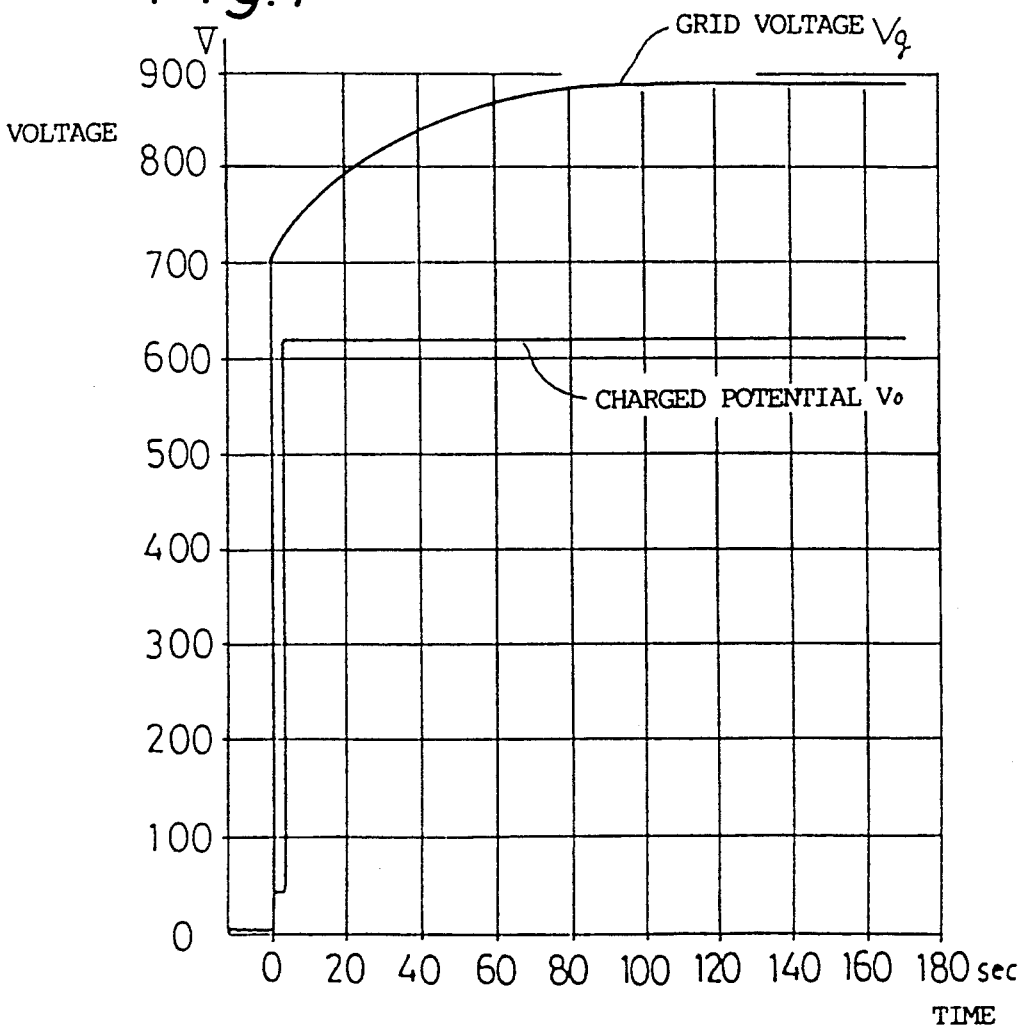
FIG. 4 is a characteristic diagram showing the states of change in charged potential and grid voltage in the present invention.

With a condition set as above, an examination has been conducted, and the grid voltage Vg and the charged potential Vo of the photoconductive drum 5 at the developing station were found as shown in FIG. 4. As it shows, the grid voltage Vg is gradually risen from its initial voltage of 710 V to 890 V. When the grid voltage is low, the discharged current from the charge wire 22 flows more to the grid 23 than the current flows to the photoconductive drum 5, while when the grid voltage Vg is risen, the discharged current from the charge wire 22 flows less to the grid 23 than the current flows to the photoconductive drum 5 since the current passes through the opening of the grid to the photoconductive drum.

Figure 7:
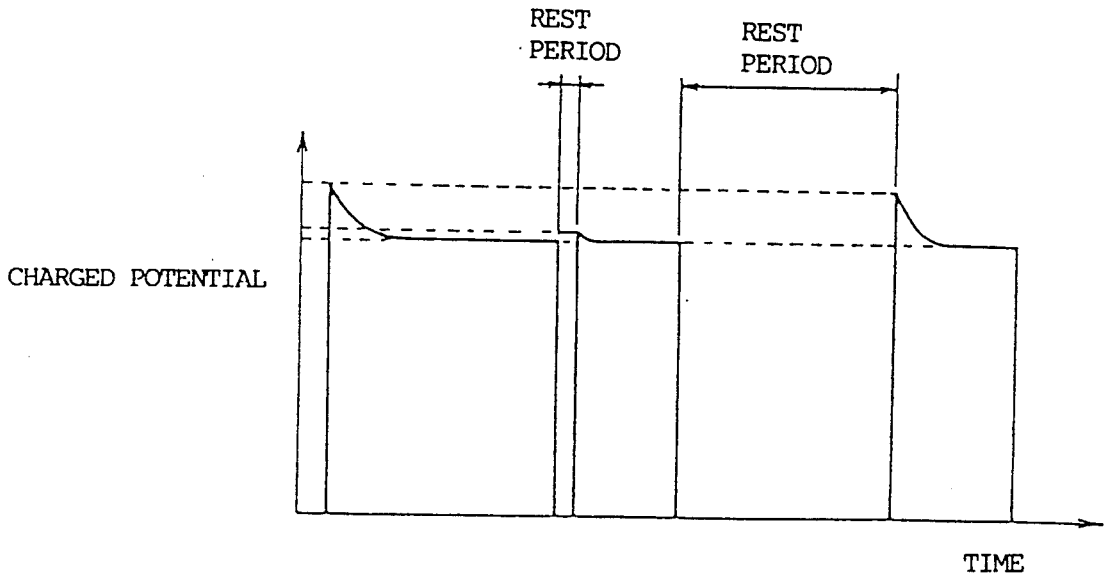
Fig.7 (PRIOR ART)
FIG. 7 is a graph showing a state of change of charged potential in a conventional device.
Figure 8:
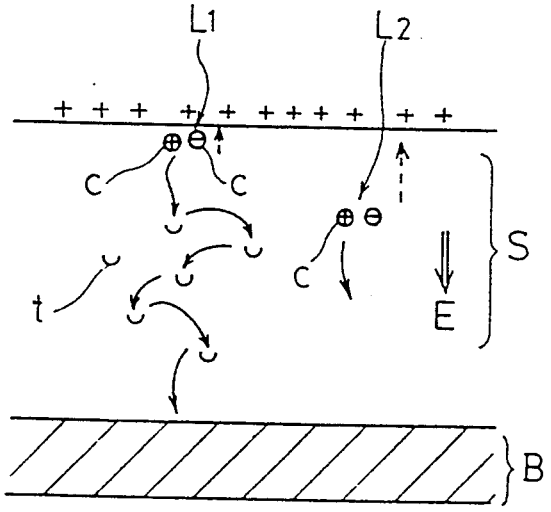
FIG. 8 is an explanatory view of light fatigue of a photoconductor.

Accordingly, in case when the present embodiment is not applied, highly charged voltage is shown when copying operation is started, and the potential is kept gradual dropping after it has abruptly dropped to converge on a certain potential as shown in FIG. 7. In the present embodiment, however, in an initial stage grid voltage is kept low and it is controlled to converge on a fixed voltage after gradual rising so that the charged voltage Vo can be maintained at a fixed potential from an initial stage as shown in FIG. 4.

Now, description will be made on the reason why the above set value is selected.

As mentioned above, in the charging characteristic of the photoconductive drum 5, the charging potential is abruptly dropped at an initial stage, and with gradual accumulation of light fatigue, the charged potential is gradually dropped to converge on a certain value. It is, therefore, important to match the capacities of the first and second condensers 28,29 for its correction. Accordingly, in case when there are changes in the kind of photoconductive drum 5, circumferential velocity of the photoconductive drum 5, the light amount of the eraser, output of the high-voltage transformer 24 and the like, the capacities of the condensers 28,30 need to be changed.

In the case of the set value of the present embodiment, the capacity of the first condenser 28 is selected at a small value in order to complete charging in a short time in compliance with the sudden drop of charging potential at an initial stage, and a large rating value is selected for the first varistor 25 since the amount of its drop is large. For the second condenser 29, a condenser which is provided with large capacity is selected in order to carry out charging action for over a long period of time in compliance with the drop of charged potential caused by the light fatigue which accumulated in a long period of time. A small rating value is selected for the second varistor 26 since the amount of its drop is small. With arrangement of the combinations of the first and second condensers 28,29 and the first and second varistors 25,26, the charging characteristic c as shown in FIG. 3 can be obtained, which corresponds to the light fatigue of the photoconductive drum 5.

When the copying operation is finished and the high-voltage transformer 24 is turned off, the corona discharge is also stopped thereby stopping the flow of the grid current I, and the electric charge accumulated in the condenser 28 is discharged through the resistor 30 which is connected in parallel therewith. Similarly, the electric charge accumulated in the condenser 29 is discharged through the resistor 31.

When the next copying operation is started during the discharge, the grid current I flowing into the condensers 28,29 is less than the case of completely discharged state since there still remain electric charge in the condensers 28,29, and the grid voltage Vg starts from a medium voltage between the value of an initial starting time and that of a regular state. As for the charging characteristic of the photoconductive drum 5, since there still remains the light fatigue, the charging potential Vo starts from a higher potential than that of the regular state if the grid voltage Vg is at a regular state. However, since the grid voltage Vg starts from a medium voltage as described above, the charged voltage Vo can be made as a fixed voltage by setting the grid voltage Vg lower in compliance with the degree of recovery of the light fatigue of the photoconductive drum 5. The resistance value of the resistors 30,31 may thus be determined to match the discharge characteristic of the condensers 28,29 with the light fatigue recovery characteristic of the photoconductive drum 5 to be used.

When the photoconductive drum 5 is at rest, the degree of progress for recovery from the light fatigue is quick at an initial stage and is gradually slowed down. When a copying operation is resumed during the recovery process from the light fatigue, a light fatigue is occurred rapidly at an initial stage. From such light fatigue and recovery characteristic of the photoconductive drum 5, in order to cope with the rapid recovery at initial rest period and correct the rapid light fatigue after resumption of copying operation, the resistance value of the first resistor 30 is set small so as to quicken the discharge of the first condenser 28, and the resistance value of the second resistor 31 is set large to slow the discharge of the second condenser 29 in view of the fact that the recovery of the light fatigue progresses slowly in the latter half of the period.

Figure 5:
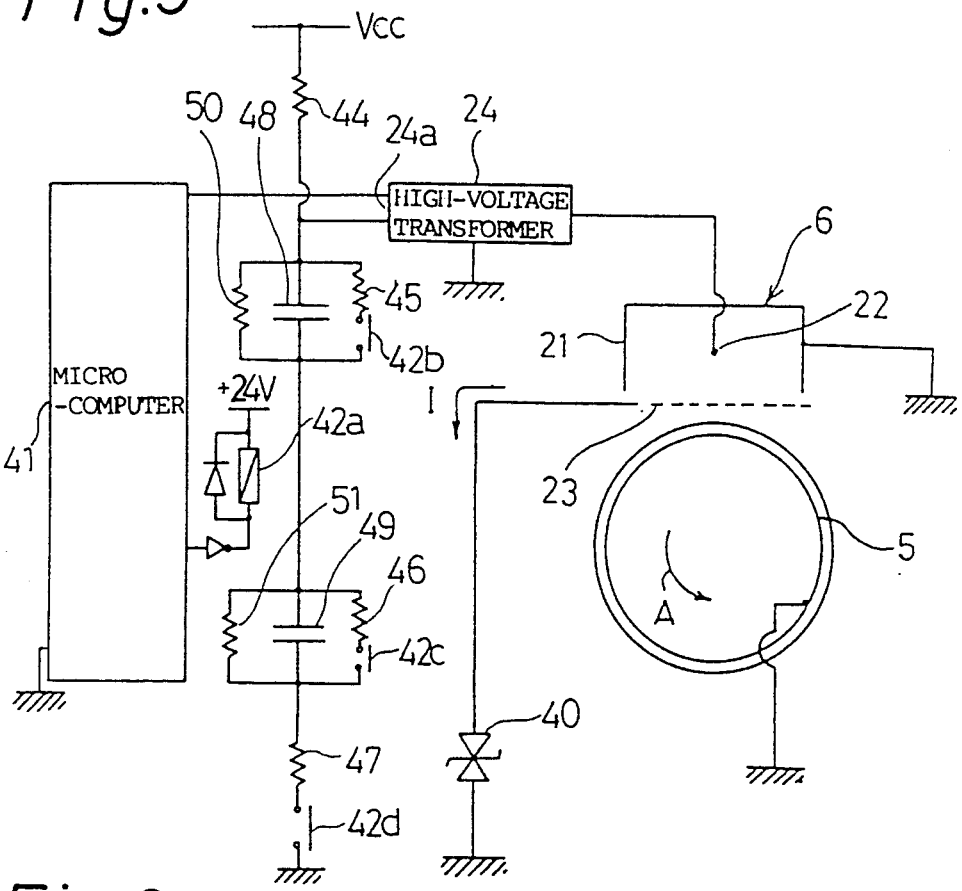
FIG. 5 is a constructional view of a charged potential control structure showing a second embodiment of the present invention.

In the above embodiment, an example is shown when grid voltage is controlled, however, it may be arranged to control output voltage of a high-voltage transformer 24 by using the same charging/discharging circuit as shown in FIG. 5. In FIG. 5, a grid 23 is grounded through a varistor 40. Into a remote terminal 24*a* of the high-voltage transformer, a voltage in which a standard voltage is divided by a resistor 44 and resistors 45,46 and 47 connected in series is inputted, and to the resistors 45,46, condensers 48,49 for charging and resistors 50,51 for discharging are connected in parallel. To the terminals on the ground side of resistors 45,46 and 47, relay terminals 42*b*, 42*c* and 42*d* which are closed and opened by control of electric application to a relay coil 42*a* with microcomputer 41 are connected in series to actuate only the resistors 50,51 when discharge of the condensers 48,49 is performed. The relay terminal 42*d* prevents the condensers 48,49 from being kept charged when copying machine is out of copying operation, while the relay terminals 42*b*,42*c* prevent the flow of discharged current to the resistors 45,46 whose resistance value is small when discharging.

With the arrangement described above, the microcomputer 41 controls the relay coil 42*a* for applying electricity, and the relay terminals 42*b*,42*c*,42*d* are turned on when the high-voltage transformer 24 is in operation, and the relay terminals 42*b*,42*c*,42*d* are turned off when the high-voltage transformer 24 is out of operation. While the condensers 48,49 are charged at the time of starting copying operation, the voltage being inputted to the remote terminal 24*a* is gradually risen until the charging is finished, and when the charging is completed, the voltage divided by the resistors 44 and the resistors 45,46,47 is inputted. When the high-voltage transformer 24 is turned off, the condensers 48,49 are gradually discharged through the resistors 50,51. With the charge and discharge of the condensers 48,49, the voltage to be inputted into the remote terminal 24*a* of the high-voltage transformer 24 is thus controlled, and the same action as that of the first embodiment can be carried out.

If the circuits of the condensers 48,49 and the resistors 50,51 are connected with intermediate portion of the remote terminal 24*a* of the high-voltage transformer 24 and the resistor 44, it may be arranged to lower output of the high-voltage transformer according to the passage of time of copying operation, and it can be effectively applied to such a photoconductor in which charged potential is risen by continuous copying operation or a photoconductor which need to be corrected to lower charged potential since residual potential is risen.

As a high-voltage transformer 24, description is made on a transformer which possesses positive characteristic wherein output voltage is risen when input voltage of the remote terminal 24*a* is raised, however, even in the case of a transformer which possesses negative characteristic, a desired characteristic may be produced by varying the combination of circuits.

Figure 6:
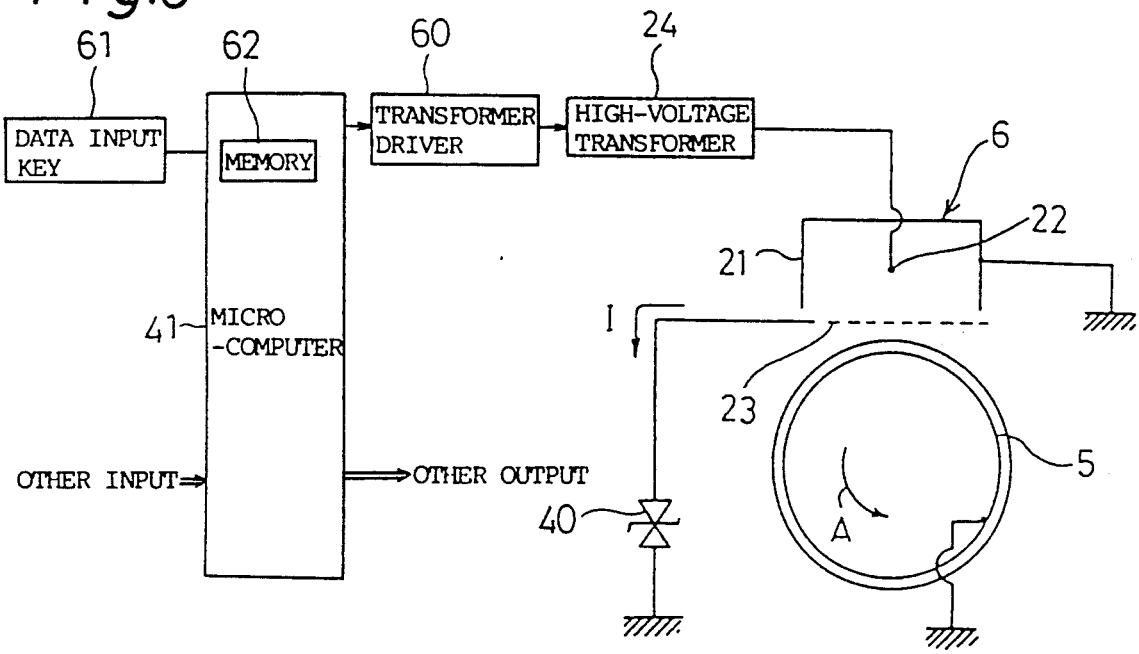
FIG. 6 is a constructional view of a charged potential control structure showing a third embodiment of the present invention.

As shown in FIG. 6, it may also be arranged to provide a transformer driver 60 for controlling output of the high-voltage transformer, and by controlling it with a microcomputer 41, the same current charging control as that of the first embodiment of the present invention may be carried out. In this case, a data input key 61 is connected to the microcomputer 41, and the data to control output of the high-voltage transformer 24 according to the attenuation characteristic of the photoconductive drum 5 is inputted. The microcomputer 41 stores the data in a memory 62, and the output of the high-voltage transformer 24 can be controlled in accordance with the data stored.

In the embodiments illustrated in FIGS. 5 and 6, descriptions are made on the examples in which grid 23 and varistor 30 are utilized, however, it may also be arranged without them. In the above embodiments, descriptions are made on the examples in which the surface of a photoconductor is charged by making use of corona discharge, however, it may also be applied to a charging device which performs charging by having brush or roller in contact with the surface of photoconductor.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:

a photoconductor;

charging means for uniformly charging the surface of the photoconductor;

means for operating the charging means;

means for forming an electrostatic latent image by exposing the photoconductor which is charged;

means for developing the electrostatic latent image; and means for controlling output of the charging means to start with a different value from a predetermined value when the charging means is operated, and for controlling the output so as to coincide with the predetermined value after a predetermined period has elapsed, wherein output characteristic of the charging means is controlled to be varied during an initial stage and during the latter half stage of the predetermined period, and wherein the control means includes a first circuit means for changing the output of the charging means by a relatively large amount in a short period of time and a second circuit means for gradually changing the output of the charging means in longer period of time than that of the first circuit means.

2. The image forming apparatus as defined in claim 1, wherein the charging means includes a wire electrode provided for discharging and a grid electrode disposed between the wire electrode and the photoconductor, a plurality of varistors being disposed in series between the grid electrode and ground, and wherein each of the first and second circuits further include a condenser and an electric resistor arranged in parallel with each other and which are connected with the varistors in parallel.

3. The image forming apparatus as defined in claim 2, wherein the capacity of the condenser and the resistance value of the electric resistor in the first circuit are smaller than those of the condenser and electric resistor in the second circuit, and wherein the rating value of the varistor to which the first circuit is connected is smaller than that of the varistor to which the second circuit is connected.

4. The image forming apparatus as defined in claim 2, wherein the means for operating the charging means is a high-voltage transformer connected to the wire electrode provided for discharging, which is controlled by a microcomputer.

5. The image forming apparatus as defined in claim 4 wherein the means for operating the charging means is a transformer driver to actuate the high voltage transformer connected to the wire electrode provided for discharging, and the control means is the microcomputer which controls the transformer driver in accordance with data inputted.

6. An image forming apparatus, comprising:

a photoconductor whose light fatigue characteristic is varied corresponding to the period when it is used and when it is not used;

charging means for uniformly charging the surface of the photoconductor;

means for operating the charging means;

means for forming an electrostatic latent image by exposing the photoconductor which is charged;

means for developing the electrostatic latent image; and circuit means for controlling output of the charging means to start with a lower output value than a predetermined value corresponding to a period when the photoconductor is not used, and for controlling the output so as to coincide with the predetermined value after a predetermined period of time has elapsed, wherein the rate of increase of the output per hour is controlled to be relatively large during an initial stage of the predetermined period, and is controlled to be relatively smaller during the latter half stage of the predetermined period.

7. The image forming apparatus as defined in claim 6, wherein the charging means includes a wire electrode provided for discharging and a grid electrode disposed between the wire electrode and the photoconductor, a plurality of varistors being disposed in series, and wherein said circuit means has a first circuit provided with a condenser and an electric resistor in which the capacity of the condenser and the electric resistance value of the electric resistor are set for charging and discharging in a short period of time so that output variation per hour of the charging means can be enlarged, and a second circuit provided with a condenser and an electric resistor in which the capacity of the condenser and the electric resistance value of the electric resistor are set for charging and discharging in a longer period of time than that of the first circuit, and wherein each of the first and second circuits are connected to each respective varistor in parallel.

8. The image forming apparatus as defined in claim 7, wherein the capacity of the condenser and the value of the electric resistance of the electric resistor in the first circuit are smaller than those of the second circuit, and wherein a rated value of the varistor to which the first circuit is connected is larger than that of the varistor to which the second circuit is connected.

9. The image forming apparatus as defined in claim 7, wherein the means for operating the charging means is a transformer driver to actuate a high-voltage transformer which is connected with the wire electrode provided for discharging, and wherein the control means is a microcomputer for controlling the transformer driver in accordance with data inputted.

* * * * *